US007485255B2

(12) United States Patent
Chretien

(10) Patent No.: US 7,485,255 B2
(45) Date of Patent: Feb. 3, 2009

(54) SELF-ANNEALING ENCLOSURE

(75) Inventor: Jacques Chretien, Terre Haute, IN (US)

(73) Assignee: Novelis, Inc., Toronto, Ontario (CA)

( * ) Notice: Subject to any disclaimer, the term of this patent is extended or adjusted under 35 U.S.C. 154(b) by 633 days.

(21) Appl. No.: 10/931,137

(22) Filed: Aug. 31, 2004

(65) Prior Publication Data

US 2006/0043653 A1 Mar. 2, 2006

(51) Int. Cl.
*C21D 9/54* (2006.01)

(52) U.S. Cl. ..... 266/256; 266/252

(58) Field of Classification Search ..... 266/252, 266/256

See application file for complete search history.

(56) References Cited

U.S. PATENT DOCUMENTS

| | | | | |
|---|---|---|---|---|
| 3,142,483 | A * | 7/1964 | Klefisch | 266/264 |
| 3,496,033 | A | 2/1970 | Gilbreath, Jr. et al. | |
| 3,593,972 | A | 7/1971 | Wehrle et al. | |
| 3,832,129 | A | 8/1974 | Derbyshire et al. | 432/77 |
| 4,142,712 | A | 3/1979 | Hemsath et al. | 266/44 |
| 4,310,302 | A | 1/1982 | Thekdi et al. | 432/205 |
| 4,502,671 | A | 3/1985 | Omura | 266/256 |
| 4,596,526 | A | 6/1986 | Soliman | 432/23 |
| 4,846,675 | A | 7/1989 | Soliman | 432/77 |
| 5,186,235 | A | 2/1993 | Ward, Jr. | 148/552 |
| 5,655,593 | A | 8/1997 | Wyatt-Mair et al. | 164/476 |
| 5,894,879 | A | 4/1999 | Wyatt-Mair et al. | 164/476 |
| 6,053,996 | A | 4/2000 | Pronk et al. | 148/541 |
| 6,346,214 | B1 * | 2/2002 | Knudsen et al. | 266/256 |
| 6,579,387 | B1 | 6/2003 | Selepack et al. | 148/552 |
| 2003/0173003 | A1 | 9/2003 | Selepack et al. | 148/551 |

FOREIGN PATENT DOCUMENTS

| | | |
|---|---|---|
| CA | 2281504 | 9/1996 |
| GB | 1 555 021 | 11/1979 |
| JP | 6306489 | 1/1994 |

OTHER PUBLICATIONS

Patent Abstracts of Japan, 06306489, "Soaking Device in Continuous Annealing Line", Jan. 11, 1994, C21D 9/62, Hirota Yoshiaki.

The Making, Shaping and Treating of Steel, Edited by Harold E. McGannon, United States Steel, 9th Edition, p. 1112, Figures 40-50 & 40-52, no date.

* cited by examiner

*Primary Examiner*—Scott Kastler
(74) *Attorney, Agent, or Firm*—Cooper & Dunham LLP

(57) ABSTRACT

An insulated, self-annealing enclosure is taught, having an enclosure body for encasing one or more heated sheet metal coils, having an open bottom for receiving the heated coils and a floor that sealingly engages the open bottom of the enclosure body. A method is also taught for batch production of annealed sheet metal coils by loading a first batch of coils into an annealing furnace and heating the coils to a predetermined temperature. Next, the heated coils are transferred to a self-annealing enclosure. A second batch of coils is then loaded into the annealing furnace. Finally, a method is described for annealing sheet metal coils, involving heating the coils in an annealing furnace to a predetermined temperature, then loading the heated coils into a self-annealing enclosure and holding the heated coils inside the enclosure for a predetermined length of time.

2 Claims, 5 Drawing Sheets

SELF-ANNEALING ENCLOSURE

FIELD OF THE INVENTION

The present invention relates to methods and devices for self-annealing sheet metal coils outside of an annealing furnace in which they are typically heated.

BACKGROUND OF THE INVENTION

In aluminum sheet and foil production processes, the sheet or foil is generally rolled into a coil and then annealed to provide desired mechanical properties. Typically, an annealing cycle involves heating the coils in a furnace to a given temperature and letting them "heat soak" for period of time. Both the steps of heating and soaking are performed in the furnace.

Operation and maintenance of such annealing furnaces is often very expensive and only a limited number are operated at a typical plant. The furnace is therefore often a limiting step in sheet and foil production and can cause bottlenecks. For example, a typical operation may use 4 batch type annealing furnaces, each furnace holding 3 coils. The heating step can take up to 8 hours, followed by a 4 hours heat soaking step. Therefore, of the total furnace cycle of 12 hours, one third is spent in non-furnace operations.

Attempts have been made in the past to avoid use of the furnace in the heat soaking step, so that the furnace can be used to heat the next batch of coils.

U.S. Pat. Nos. 5,655,593 and 5,894,879 disclose a rapid cooling process followed by casting that eliminates altogether heating and soaking steps, but do not discuss more efficient use of the furnaces.

U.S. Pat. No. 6,053,996 relates to the treatment of steel and refers to holding an intermediate slab in an enclosure for temperature homogenization, but does not teach methods of heat soaking for annealing purposes.

U.S. Pat. No. 6,579,387 and U.S. 2003/0173003 teach a continuous annealing process in which the strip is heated and then heat soaked in the same induction heater.

U.S. Pat. No. 4,846,675 discloses an enclosure used for annealing batches of metal coils. The enclosure is provided with a heating hood or a cooling hood, and would not be used exclusively for heat soaking.

British Patent 1 555 021 relates primarily to the treatment of steel and provides an enclosure that is used for both heating and heat soaking steps of annealing. U.S. Pat. Nos. 4,142,712 and 4,310,302 are further examples of coil enclosures used as heater for heat-treatment of metal coils.

It is therefore greatly desired to develop a method and apparatus to separate the heating step of a batch annealing process from the heat soaking step, thereby freeing the furnace for heating a next batch of coils.

SUMMARY OF THE INVENTION

According to one aspect of the present invention, there is thus generally provided an insulated, self-annealing enclosure for heated sheet metal coils. In another aspect of the invention, the enclosure comprises an enclosure body for encasing one or more heated coils, having an open bottom for receiving the heated coils and a floor that sealingly engages the open bottom of the enclosure body.

According to another aspect, the present invention provides a method of producing annealed sheet metal coils in a batch production comprising loading a first batch of coils into an annealing furnace and heating the coils until a predetermined temperature is reached on an outer envelope of the coils. Next, the first batch of heated coils is transferred from the furnace to an insulated, self-annealing enclosure. A second batch of coils is then loaded into the annealing furnace.

According to yet another aspect of the present invention, there is provided a method for annealing coiled sheet metal, comprising heating the coil in an annealing furnace until a predetermined temperature is reached on an outer envelope of the coil, then removing the heated coil from the furnace and loading it in an insulated, self-annealing enclosure and finally, holding the heated coil inside the enclosure for a predetermined length of time to soak the coil.

BRIEF DESCRIPTION OF THE DRAWINGS

Preferred embodiments of the present invention are described below, in conjunction with the accompanying figures, wherein.

DETAILED DESCRIPTION OF THE PREFERED EMBODIMENTS

The present invention allows for the furnace to be used exclusively to heat the coils, while heat soaking is conducted outside of the furnace, in a self-annealing enclosure. The self-annealing enclosure is much less expensive to operate than the furnace, as it comprises an insulated box with no burners, valves or controllers.

In removing the coils as soon as the heating phase is completed, the furnace is made available earlier for a new batch of coils, which in turn reduces the turn-around time of the furnace and increases productivity.

The present invention is partly based on the observation that there is enough heat stored in the coils at the end of the heating step to allow the coils to. "self anneal" if the coils are transferred to a well insulated enclosure where the extra heat, stored in the outer envelope of the coil, tends to migrate towards the inner loops of the coil, allowing the coil to self-anneal. The enclosure is generally shaped and dimensioned to encase and support a predetermined number of coils for heat-soaking.

The term "heat-soaking" as used in the context of the present invention defines the process of first equalizing the temperature throughout the body of the coil and then holding the coil at a desired temperature for a pre-determined length of time, for such purposes as reducing hardness, facilitating cold working, producing a desired microstructure, or obtaining desired mechanical, physical, or other properties. Heat soaking can also relate to a heat treatment designed to soften an age-hardened metal. Once a metal is heat soaked it can is usually desirable to cool the metal at a suitable rate to reduce any stresses.

Figure 1:
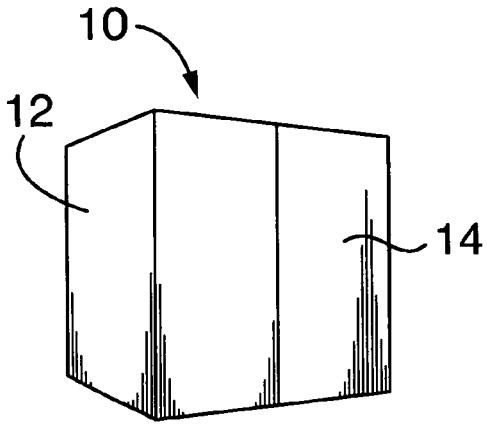
FIG. 1 is a perspective view of a first embodiment of the enclosure of the present invention in a closed position.
Figure 2:
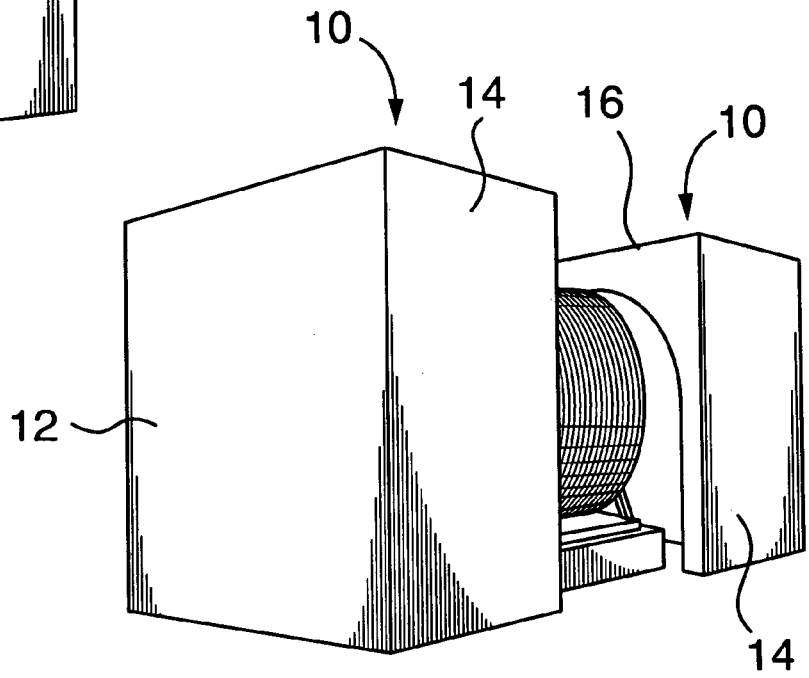
FIG. 2 is a perspective view of FIG. 1 in an open position, loaded with a coil.
Figure 3:
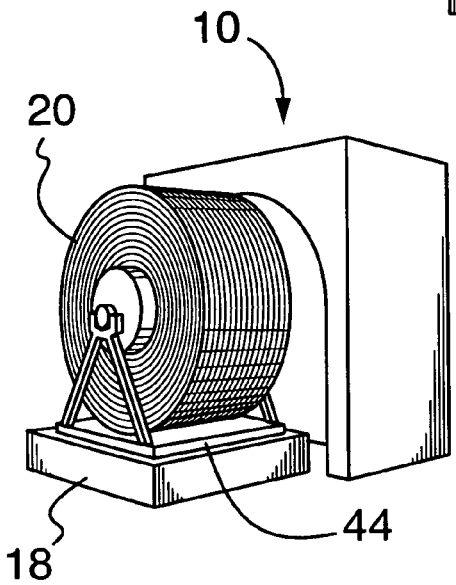
FIG. 3 is a perspective view of FIG. 1 showing one half of the enclosure, loaded with a coil.
Figure 4:
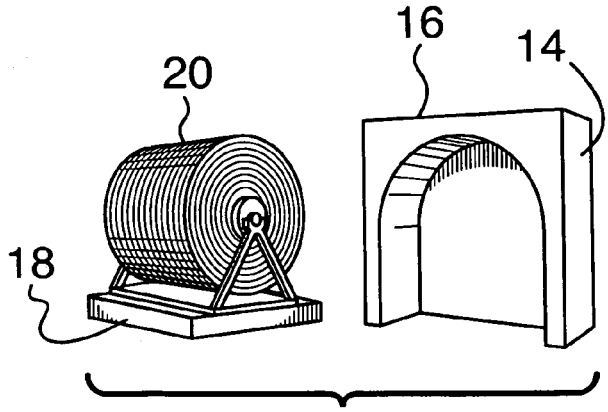
FIG. 4 is a cross sectional view of FIG. 1, together with a coil.

A first embodiment of the present enclosure is illustrated in FIGS. 1 to 4. As seen in FIGS. 2, 3 and 4, the enclosure comprises two enclosure halves 10, each half comprising an end wall 12, two half side walls 14 and a half of a top wall 16. The halves 10 are designed to sealingly engage one another, as seen in FIG. 1. Sealing means (not shown0 for sealing engaging the two enclosure halves can include, for example, rubber gaskets or other sealing devices well known in the art. Referring to FIGS. 3 and 4, the enclosure also comprises a floor 18 onto which a heated coil 20 can be mounted, and which can fit into and sealingly engage the enclosure halves 10.

As used in the context of the present invention, the term "sealingly engage" means that the parts abut against each other without substantial gaps so that air inside the container does not exchange freely with air outside, thereby avoiding heat loss by means of air currents passing around the container walls.

Figure 5A:
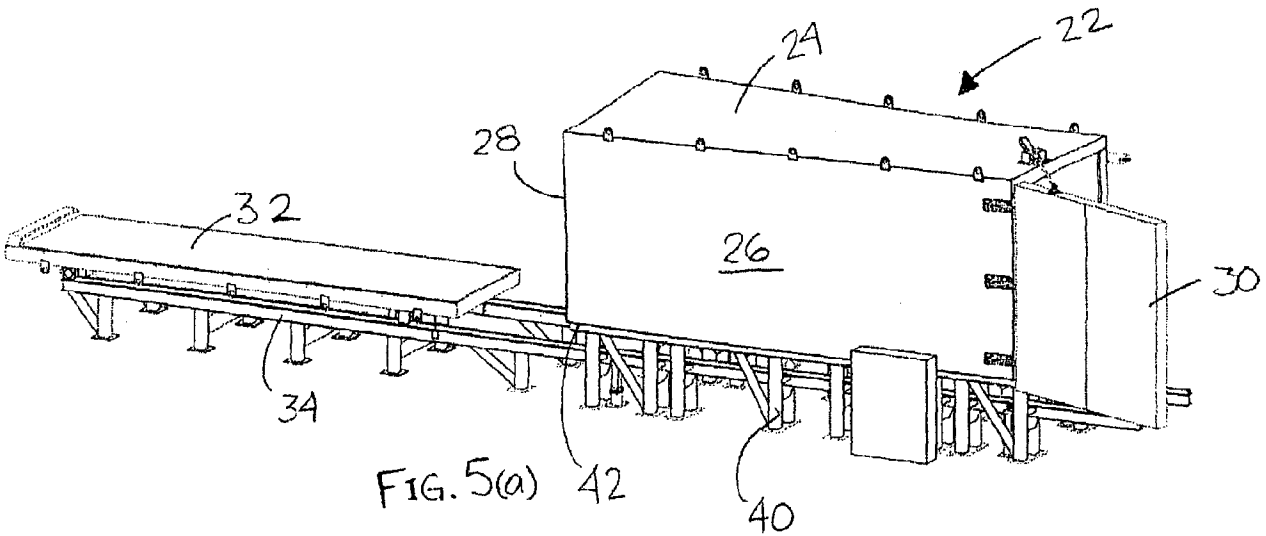
FIG. 5*a* is a perspective view of a second embodiment of the enclosure, with a movable floor.
Figure 5B:
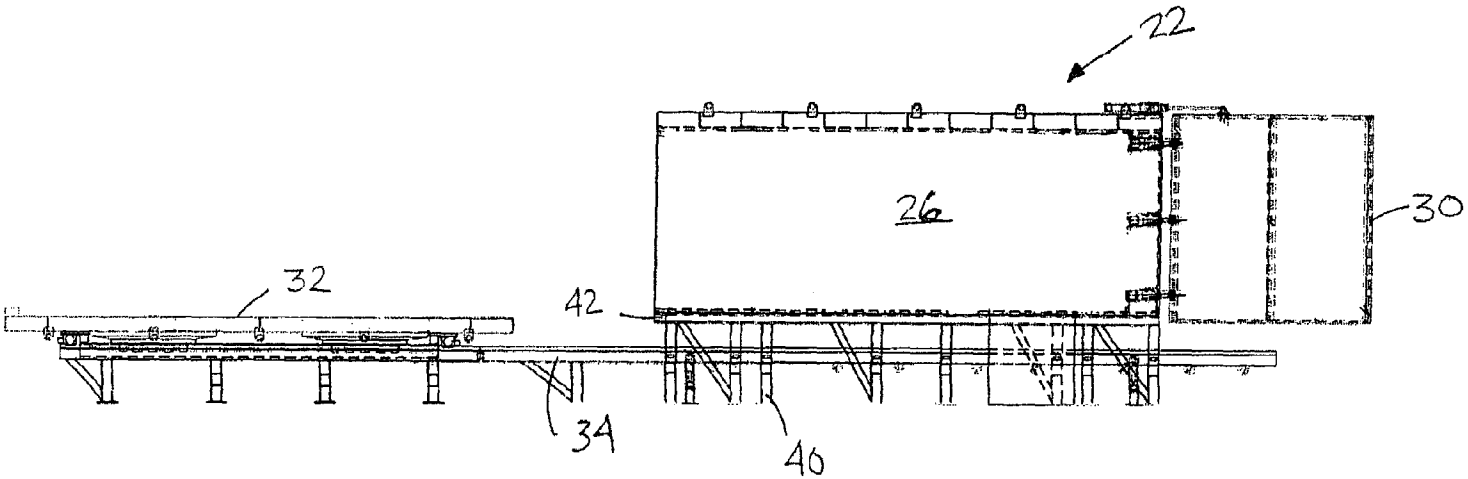
FIG. 5*b* is a cross sectional view of FIG. 5*a;*
Figure 6A:
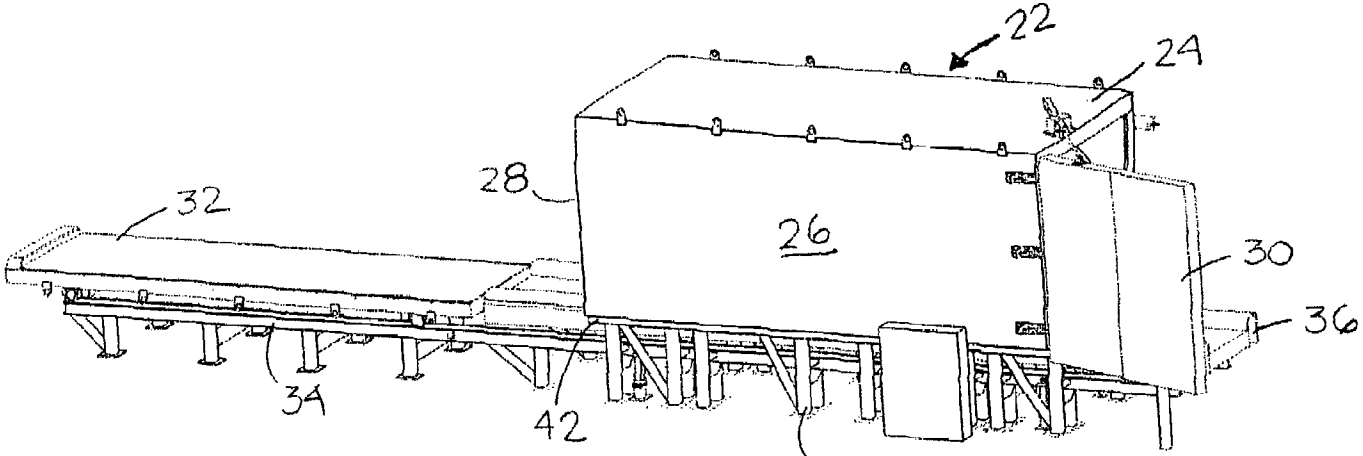
FIG. 6*a* is a perspective view of the embodiment of FIG. 5*a,* showing a transfer pallet and the movable floor.
Figure 6B:
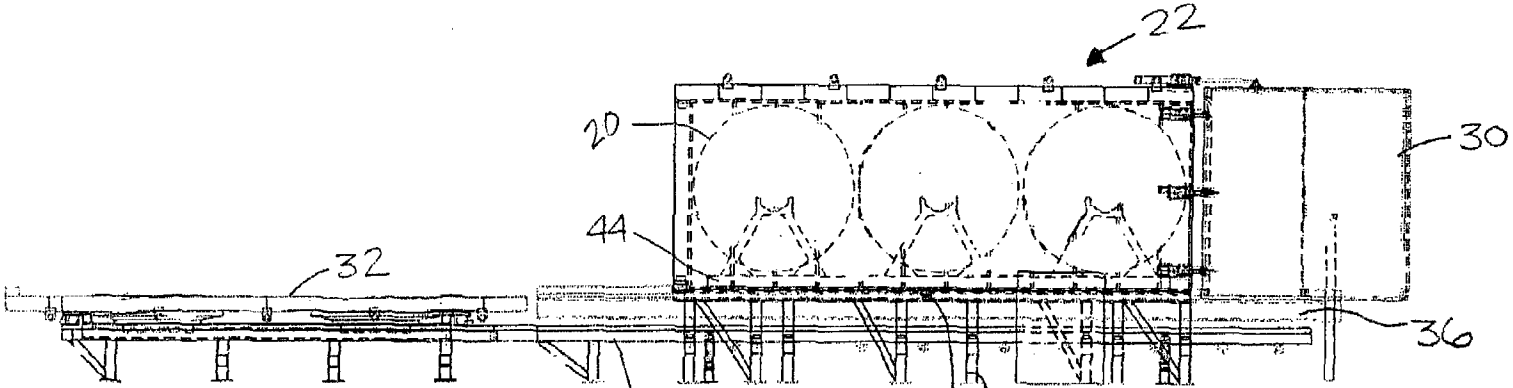
FIG. 6*b* is a cross sectional view of FIG. 6*a;*
Figure 7A:
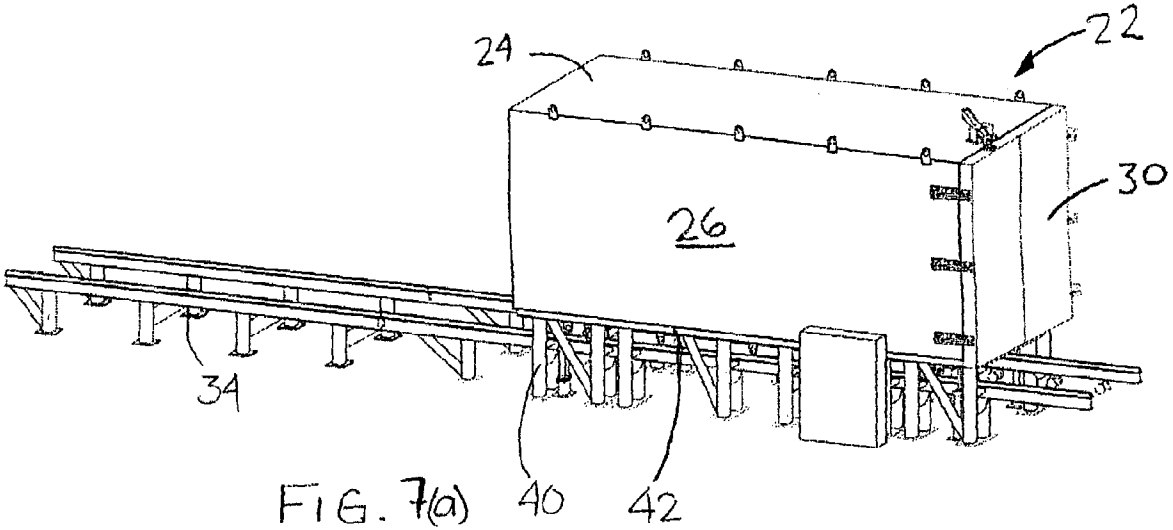
FIG. 7*a* is a perspective view of the embodiment of FIG. 5*a,* in a closed position.
Figure 7B:
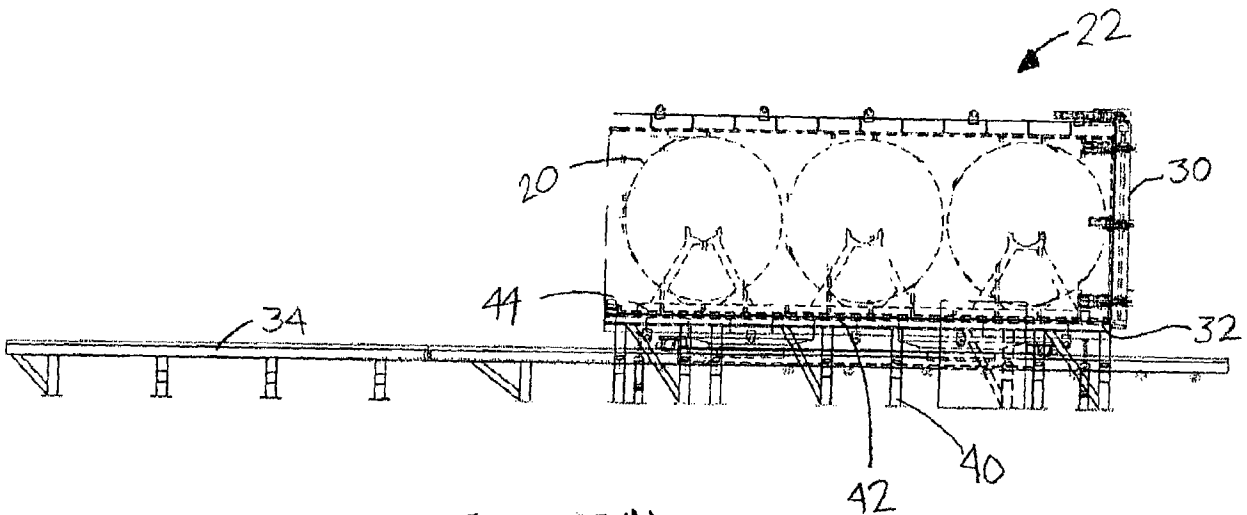
FIG. 7*b* is a cross sectional view of FIG. 7*a;*.

A second, preferred, embodiment of the invention is shown in FIGS. 5*a* to 7*b*. In this embodiment as illustrated, the enclosure comprises an enclosure body 22 that can hold 3 heated coils 20 in a row. Referring to FIG. 5*a*, the enclosure body 22 comprises a top wall 24, two side walls 26, an end wall 28 and a frame 40, said frame 40 comprising two coil-supporting ledges 42 that project into the enclosure body 22. A door 30 sealingly engages the enclosure body 22.

The enclosure also comprises a movable floor 32 that is rolled under the heated coils 20 and fits between the ledges 42 of the frame 40 to sealingly engage a lower end of the enclosure.

Preferably, the movable floor 32 moves along a pair of tracks 34 that run under and extend beyond the enclosure. The movable floor 32 is designed to roll along the tracks 34 and engage an open bottom of the enclosure in a locking fashion.

Figure 8:
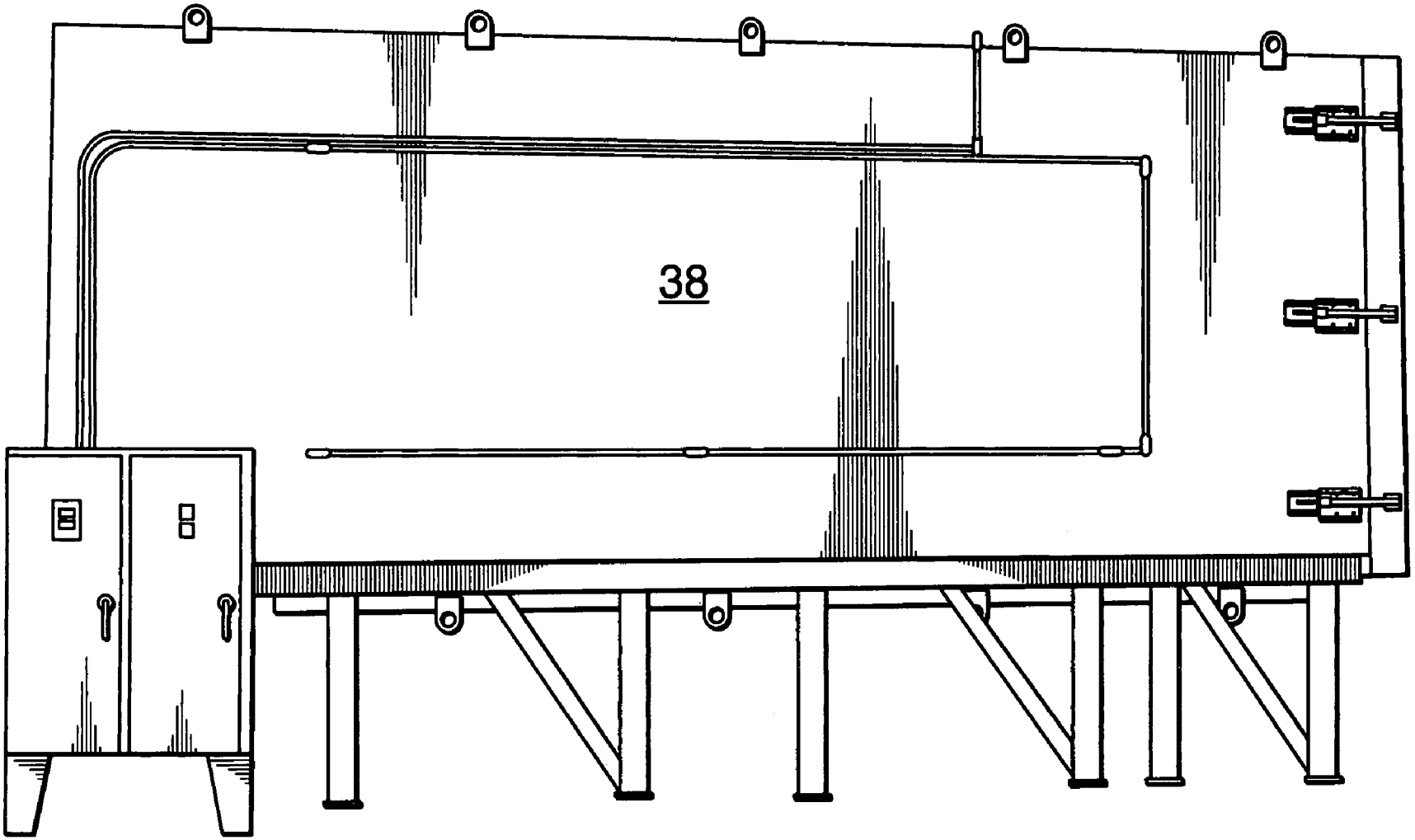
FIG. 8 is an elevation view of a typical annealing furnace for use with the present invention.

In a preferred mode of operation, three heated coils 20, each resting on a tray 44, are unloaded from the annealing furnace 38, as shown in FIG. 8, onto a loading pallet 36. Each tray 44 is wider than the pallet 36 and overhangs the pallet 36. The pallet 36 is then moved along the tracks 34 into the enclosure through the door 30. The loading pallet is narrow enough to pass between the ledges 42 of the frame 40, however trays 44 are wider and therefore rest on top of ledges 42 and are supported by the ledges 42. The pallet 36 can then be moved out from under the enclosure. The movable floor 32 is next rolled along the tracks 34 and under the coils 20, between ledges 42 and sealingly engages the open bottom of the enclosure to seal it closed.

Preferably the door 30 is hinged to one of the side walls 26 and can be locked to the other of the side walls 26 by, for example, latching means that project from the other of the side walls 26 and engage the door 30 when closed.

Typical dimensions of a self-annealing enclosure of the present invention can be 100 inches to 110 inches in length, from 100 inches to 110 inches in depth and from 100 inches to 110 inches in height for holding 1 coil, as in the first embodiment, and 300 inches in length, 100 inches to 110 inches in depth and 100 inches to 110 inches in height for holding 3 coils, as in the second embodiment.

The various walls and the floor of the enclosure are all insulated to minimize temperature loss in the heated coil during heat soaking. A tolerable rate of temperature loss in the coils during heat soaking is preferably from 1° C. to 2° C. per hour.

Preferably the insulation has a total R-value of from 30 to 40. Suitable insulators for the enclosure can include, for example, mineral wool or any high temperature industrial board insulation. The mineral wool can be between 8 and 12 inches thick and is preferably 10 inches in thickness.

The self-annealing enclosure of the present invention acts to relieve bottleneck problems in the process flow of aluminum foil and sheet production. Building an additional furnace can involve large investments in the range of millions of dollars, and would only incrementally increase the productivity of the annealing process center. By comparison, inclusion of a self-annealing enclosure can reduce cycling time of the furnace, allowing for new batches to be heated sooner.

For a typical annealing production unit, the addition of three self-annealing enclosures would have the same impact as building a new furnace, at only about 15% of the cost.

In a preferred embodiment, the self-annealing enclosure could be used for partial anneal applications, such as H2X.

This detailed description of the devices of the present invention is used to illustrate the prime embodiment of the present invention. It will be apparent to those skilled in the art that various modifications can be made in the present devices and that various alternative embodiments can be utilized. Therefore, it will be recognized that modifications can be made in the devices of the present invention and in the application of these devices without departing from the scope of the invention, which is limited only by the appended claims.

The invention claimed is:

1. An insulated, self-annealing enclosure for heated sheet metal coils, comprising: a. an enclosure body for encasing and supporting one or more heated coils, having an open bottom for receiving the heated coils; and b. a floor that sealingly engages the open bottom of the enclosure body; wherein the enclosure body comprises two enclosure halves, each half having an open bottom to receive the heated coils and sealing means to sealingly engage the floor and to sealingly engage with one another.

2. The self-annealing closure of claim 1 having dimensions of from 100 inches to 110 inches in length, from 100 inches to 110 inches in depth and from 100 inches to 110 inches in height.

* * * * *